US006518938B1

(12) United States Patent
Chaoo

(10) Patent No.: US 6,518,938 B1
(45) Date of Patent: Feb. 11, 2003

(54) SIMPLIFIED HELICAL ANTENNA STRUCTURE FOR COMMUNICATION EQUIPMENT

(75) Inventor: Jacko Chaoo, Pa-Te (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/985,208

(22) Filed: Nov. 2, 2001

(51) Int. Cl.[7] ..... H01Q 1/36
(52) U.S. Cl. ..... 343/895; 343/702
(58) Field of Search ..... 343/702, 895, 343/872, 873, 900, 715; 455/90; 29/600

(56) References Cited

U.S. PATENT DOCUMENTS 5,436,633 A * 7/1995 Liu ..... 343/723
5,905,475 A * 5/1999 Annamaa ..... 343/895
6,337,669 B1 * 1/2002 Chiang ..... 343/895
6,340,955 B1 * 1/2002 Chao ..... 343/895

* cited by examiner

*Primary Examiner*—Don Wong
*Assistant Examiner*—James Clinger
(74) *Attorney, Agent, or Firm*—Troxell Law Office PLLC

(57) ABSTRACT

A simplified helix antenna structure for communication equipment, the antenna is mounted in an internal insulating sleeve thereof with a spiral coil for receiving and emitting signals, the spiral coil is positioned in the antenna under pressure; the bottom end of the spiral coil is a downwardly extending portion which has a specific length with partial length thereof exposed to the outside of the antenna, and the end of the extending portion is electrically connect with an antenna line of an electric circuit board inside of the communication equipment after assembling of the antenna on the equipment. The elastic contact piece and the internal metallic receiving seat used conventionally can thus be saved, and the structure of the helix antenna can be simplified.

2 Claims, 4 Drawing Sheets

SIMPLIFIED HELICAL ANTENNA STRUCTURE FOR COMMUNICATION EQUIPMENT

BACKGROUND OF THE INVENTION

1. Field of the Invention

The present invention is related to a simplified helical antenna structure for communication equipment, and especially to an antenna which is extensible directly to electrically connect with an electric circuit board inside of a machine body for simplifying components.

2. Description of the Prior Art

A helix antenna of which the spiral coil is formed by winding metallic wires is the major type of antenna. Helix antenna of such structure will affect the set function in every aspect. Such as the helix antenna disclosed in British patent No. 2,206,243, it decides the proper function of the whole helix antenna by the factors including the diameter or the material of the wires of a helix coil or the pitch between rings of the helix coil or the overall length of the helix coil of the helix antenna.

FIG. 1 shows a fixed miniature antenna of a mobile phone, it can be combined on the top of the mobile phone in a snap-in mode. Basically, such a fixed miniature antenna of a mobile phone is provided generally in the interior of an external insulating sleeve 10 thereof (namely, the exposed pipe of the antenna) with an internal insulating sleeve 11 for positioning therein a metallic receiving seat 12. A top surface 13 of the metallic receiving seat 12 is mounted thereon a coil 15 to cooperate with the inner upper surface 14 of the external insulating sleeve 10; while a lower portion 16 thereof can be mounted thereon a partially exposed elastic contact piece 17. The elastic contact piece 17 is used to electrically connect with a reserved antenna line of an electric circuit board inside of the mobile phone. But the defect of such conventional helix antenna resides in that, an additional kind of material is required to form the elastic contact piece 17, and an additional assembling process is required to connect the elastic contact piece 17 to the interior of the antenna, and thereby such assembling process is more troublesome and time consumptive.

SUMMARY OF INVENTION

An object of the present invention is to provide a simplified helical antenna structure for communication equipment, whereof, an inside spiral coil can be extended downwardly out of the antenna, and the exposed extension end thereof can be electrically connected with an electric circuit board inside of a mobile phone. In this way, an elastic contact piece and its related assembling process can be omitted, thus the internal structure of the antenna can be simplified. This is the primary motive of the present invention.

The present invention will be apparent in its novelty and other characteristics after reading the detailed description of the preferred embodiment thereof in refereference to the accompanying drawings. Wherein:

DETAILED DESCRIPTION OF THE PREFERREDMBODIMENT

Figure 1:
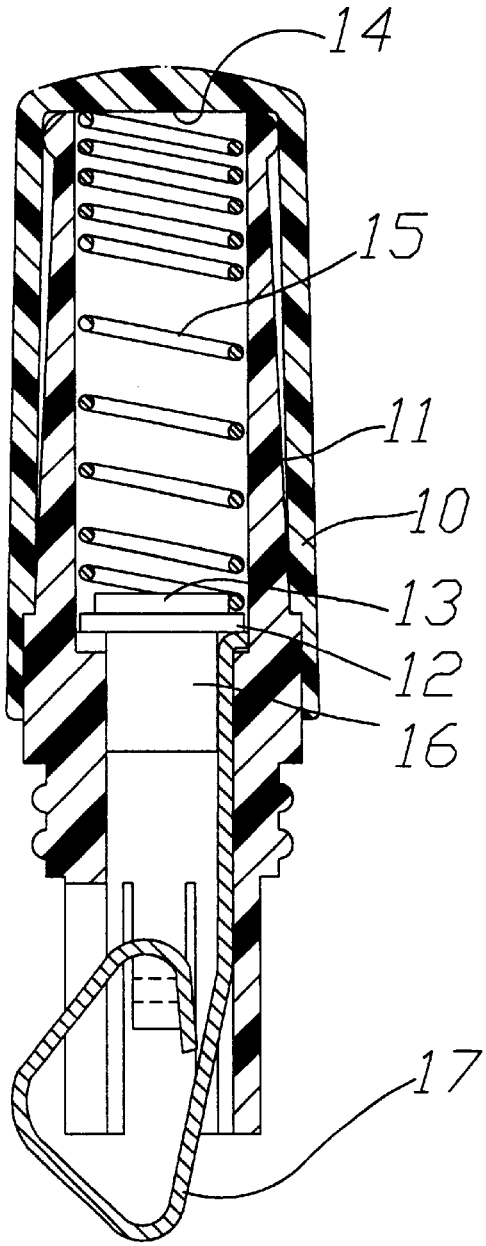
(PRIOR ART) FIG. 1
FIG. 1 is a sectional view of a conventional helical antenna.
Figure 2:
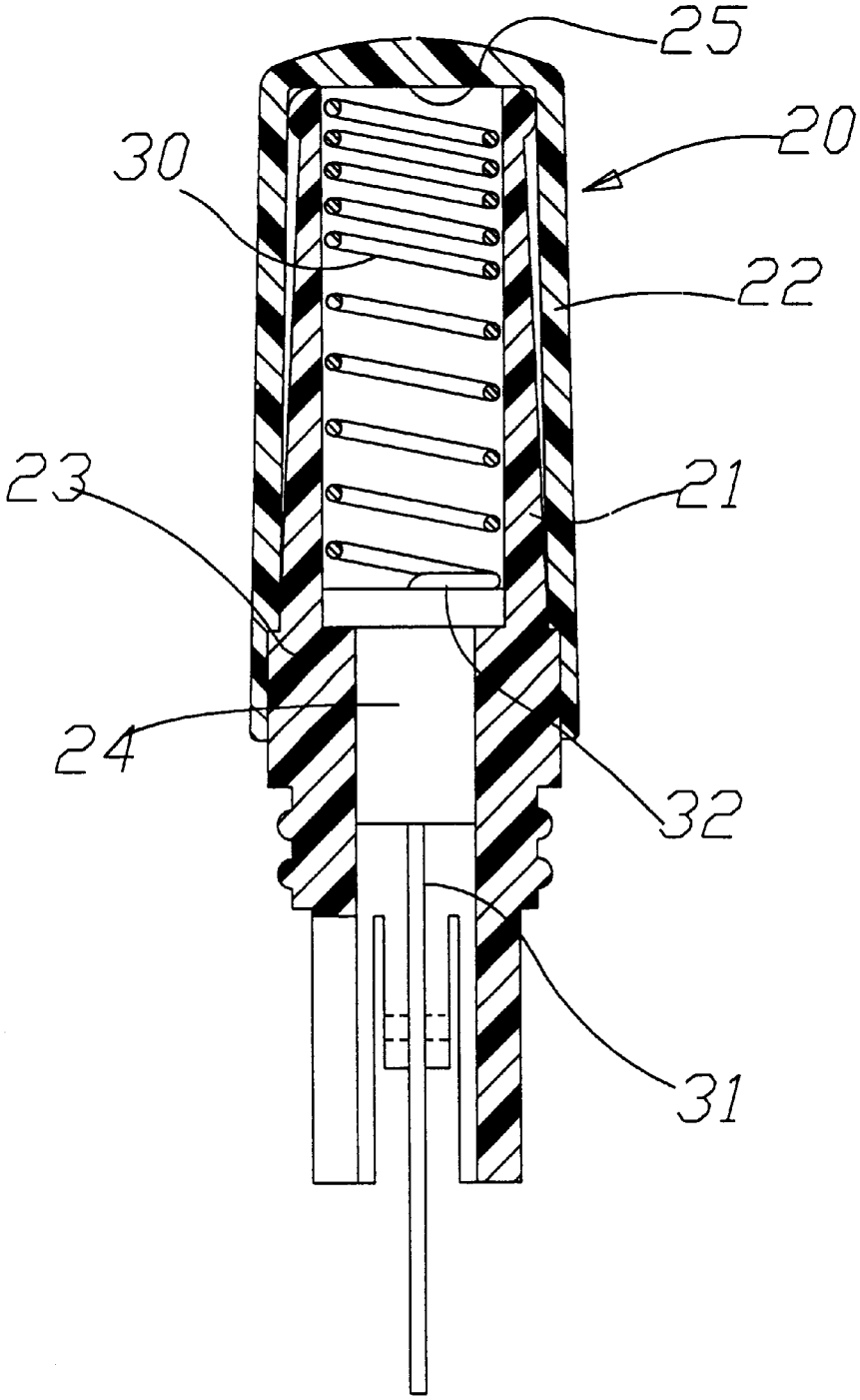
FIG. 2 is a sectional view of a preferred embodiment of the present invention.

Referring to FIG. 2, in the embodiment of a fixed antenna 20 of the present invention, the antenna 20 is also comprised of an internal insulating sleeve 21 and an external insulating sleeve 22, and is mounted therein with a spiral coil 30 for receiving and emitting signals. This embodiment is only for explanation, it can also be of other types, such as an antenna structure directly enveloped to form thereon a cap.

In the above stated embodiment, the internal insulating sleeve 21 has an inner step-like portion 23 for assembling a metallic receiving seat 24, the upper and the lower ends of the spiral coil 30 are respectively abutted against the inner top surface 25 of the external insulating sleeve 22 and the metallic receiving seat 24 after assembling. The present invention is primarily characterized by that, the bottom end of the spiral coil 30 is a downwardly extending portion 31 which has a specific length with partial length thereof exposed to the outside of the body of the antenna 20 after extending through the metallic receiving seat 24.

In the preferred embodiment shown, the spiral coil 30 is bent on the end thereof to form a diametrically directed portion 32 of which the tailing end is bent to form the downwardly extending portion 31. This type of spiral coil 30 can surely be made by mass production in a factory.

Figure 3:
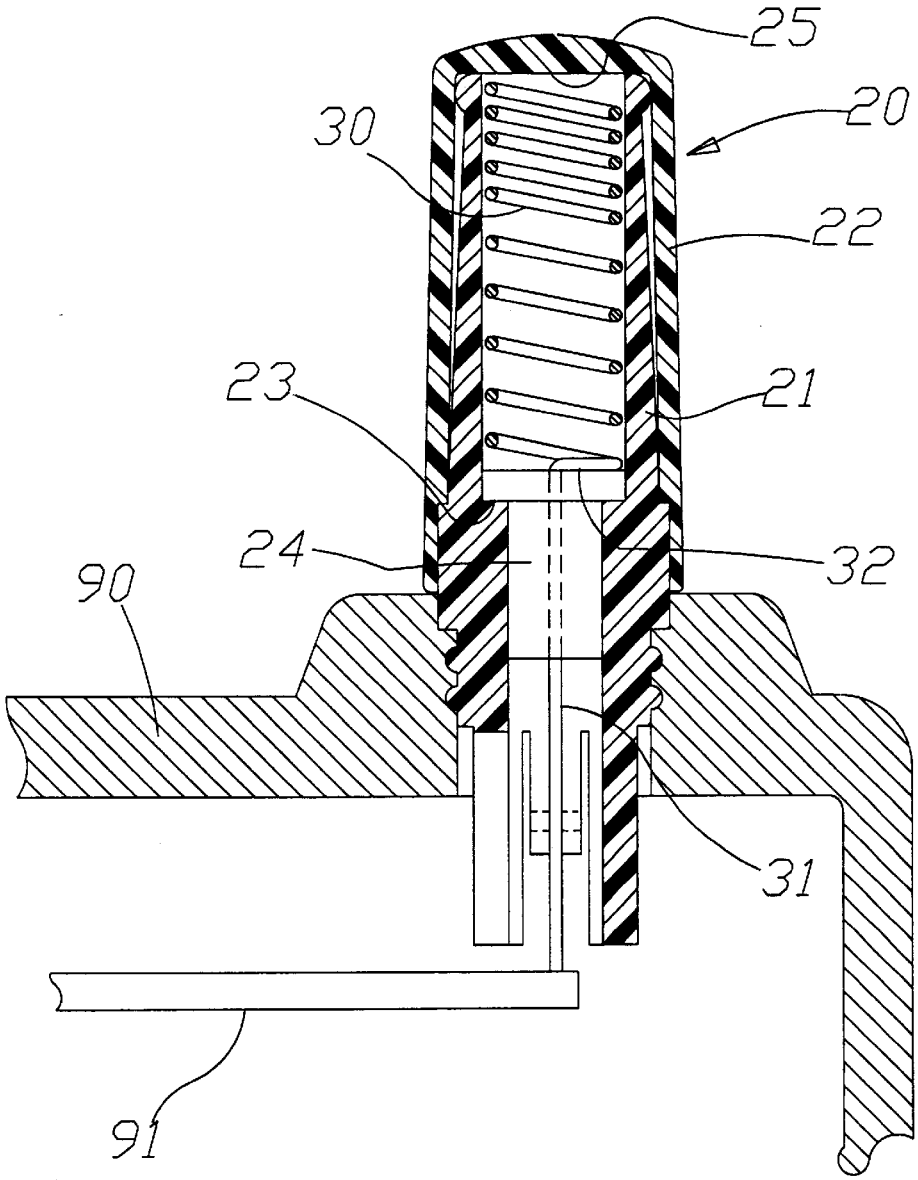
FIG. 3 is a schematic view showing the embodiment of FIG. 2 is mounted on a mobile phone.

As shown in FIG. 3, when the antenna 20 of the above stated structure is assembled on a communication instrument 90 such as a mobile phone, the exposed end of the extension portion 31 directly electrically connects with an antenna line of an electric circuit board 91 inside of the mobile phone. Because that such coils are made of the material such as steel plated with copper, they have suitable flexibility and elasticity, they can be stably electrically connected with an antenna line. Another feasible embodiment can also have electrically, conductive material on the end of the antenna line of the electric circuit board to electrically connect with the exposed end of the abovementioned extension portion.

Figure 4:
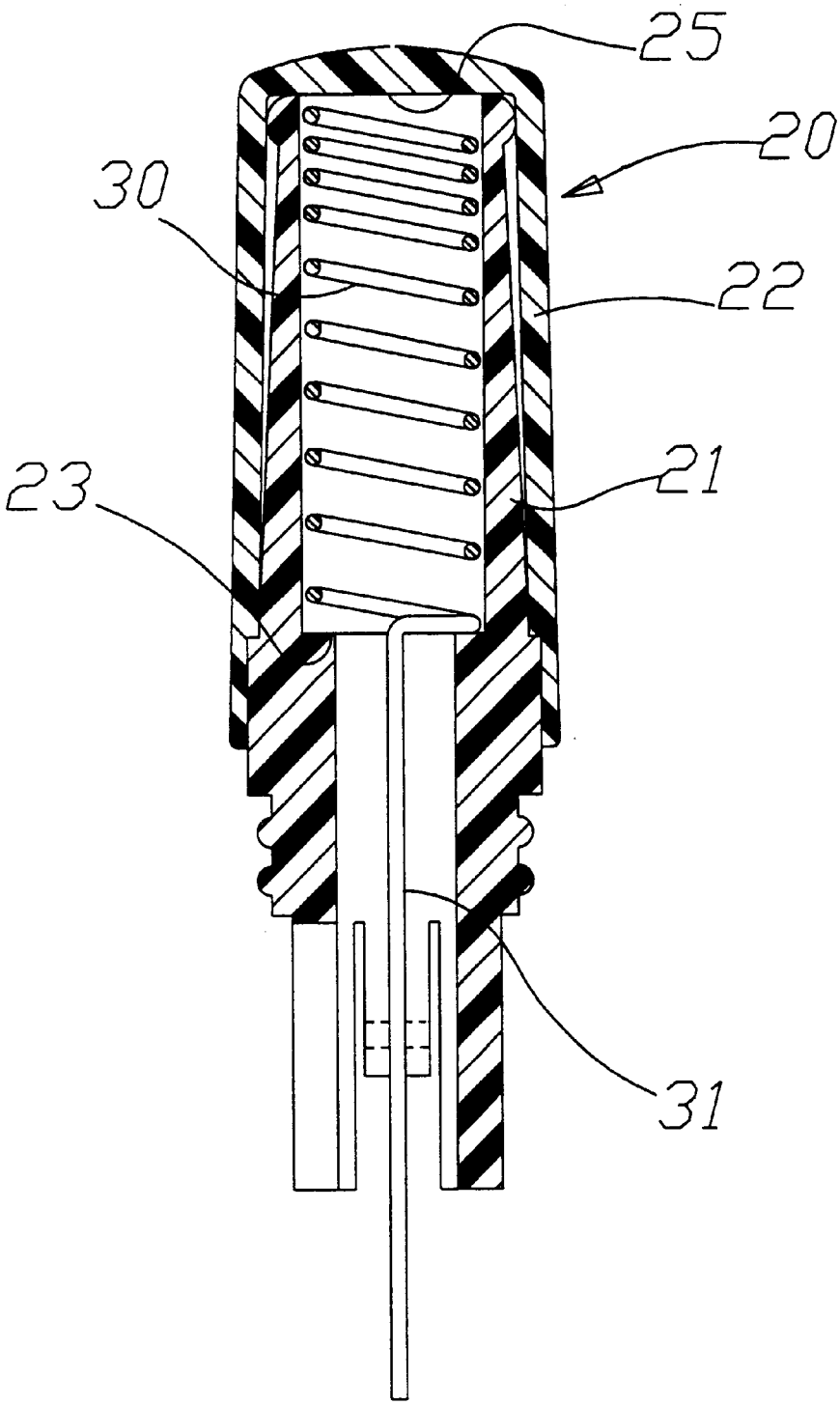
FIG. 4 is a schematic view of another embodiment of the present invention.

Referring to FIG. 4, the improved structure of the present invention can further save the internal metallic receiving seat. And in this preferred embodiment shown, the upper and the lower ends of the spiral coil 30 are respectively abutted against the inner top surface 25 of the external insulating sleeve 22 and the inner step-like portion 23 of the internal insulating sleeve 21, then the bent extension portion 31 is extended directly outwardly. By the fact that the internal insulating sleeve 21 and the external insulating sleeve 22 are connected by adhering or melting onto the step-like section provided, the reserved length for the spiral coil 30 is slightly larger than the distance from the inner top surface 25 of the external insulating sleeve 22 and the inner step-like portion 23 of the internal insulating sleeve 21, thereby the spiral coil 30 is slightly under pressure after assembling and positioning, the resistive reaction to the pressure thereby can make the spiral coil 30 positioned in the interior of the antenna.

Such improved designing of the present invention thereby can have a simplified internal structure of the helix antenna, wherein, it saves the elastic contact piece and the internal metallic receiving seat used conventionally, thus cost of production is effectively reduced, this is beneficial to fast mass production.

The preferred embodiment disclosed above is only for illustrating the present invention. It will be apparent to those skilled in this art that various modifications or changes can be made to the elements of the present invention without departing from the spirit of this invention. Accordingly, all such modifications and changes also fall within the scope of the appended claims and are intended to form part of this invention.

What is claimed is:

1. A helical antenna structure for communication equipment, comprising:

a) an internal insulating sleeve having an open uppermost end, an open lowermost end and an inner step portion in an interior of the internal insulating sleeve;

b) a spiral coil for receiving and emitting signals located in the internal insulating sleeve, the spiral coil in contact with the inner step portion and including a linear extension portion extending from the inner step portion to a position beyond the lowermost end of the internal insulating sleeve so as to enable direct contact with a circuit board of the communication equipment; and, c) an external insulating sleeve mounted on the internal insulating sleeve so as to cover the open uppermost end of the internal insulating sleeve.

2. A helical antenna structure for communication equipment, comprising:

a) an internal insulating sleeve having an open uppermost end, an open lowermost end and an inner step portion in an interior of the internal insulating sleeve;

b) a metallic receiving seat in the internal insulating sleeve in contact with the inner step portion;

c) a spiral coil for receiving and emitting signals located in the internal insulating sleeve, the spiral coil including a linear extension portion extending from the inner step portion to a position beyond the lowermost end of the internal insulating sleeve so as to enable direct contact with a circuit board of the communication equipment; and, d) an external insulating sleeve mounted on the internal insulating sleeve so as to cover the open uppermost end of the internal insulating sleeve.

* * * * *